US005376779A

United States Patent [19]

Tomotsune

[11] Patent Number: 5,376,779

[45] Date of Patent: Dec. 27, 1994

[54] GATE APPARATUS USING ID INFORMATION RECORDING MEDIUM

[75] Inventor: Yoshikazu Tomotsune, Yokohama, Japan

[73] Assignee: Kabushiki Kaisha Toshiba, Kawasaki, Japan

[21] Appl. No.: 142,937

[22] Filed: Oct. 29, 1993

[30] Foreign Application Priority Data

Mar. 25, 1993 [JP] Japan ..... 5-066967
Sep. 3, 1993 [JP] Japan ..... 5-219955

[51] Int. Cl.[5] ..... G07B 15/02

[52] U.S. Cl. ..... 235/384; 235/382; 235/382.5

[58] Field of Search ..... 235/382, 382.5, 384

[56] References Cited

U.S. PATENT DOCUMENTS 4,357,530 11/1982 Rofes et al. ..... 235/384

*Primary Examiner*—Harold Pitts
*Attorney, Agent, or Firm*—Cushman, Darby & Cushman

[57] ABSTRACT

A gate apparatus is provided a convey path enabling an IC card (ID information storage medium) to be inserted and discharged from either of a front side and a rear side of the gate apparatus and, therefore, entering/exiting can be monitored by the single gate apparatus. A CPU determines the direction of discharge of the IC card on the basis of detection results of a card sensor and a door state detecting means. Thus, entering/exiting information can exactly be understood.

13 Claims, 11 Drawing Sheets

GATE APPARATUS USING ID INFORMATION RECORDING MEDIUM

BACKGROUND OF THE INVENTION

1. Field of the Invention

The present invention relates to a gate apparatus, installed at an entrance/exit of a specified area where secrecy is required, such as a factory or a research center, for monitoring and managing incoming/outgoing of a person or an object (e.g. vehicle) by using an ID information recording medium such as an ID card.

2. Description of the Related Art

A conventional gate apparatus is installed on the entrance side of a specified area, e.g. a research center, thereby managing incoming data of an owner of an ID card. When the owner of the ID card inserts the card into the gate apparatus, the lock is deactivated, and the card owner can open the door and enter the specified area. In this case, through a sequence of operations, three data items on the card owner, the deactivation of the lock and the opening of the door are obtained. Based on these data items, it is judged whether the card owner has entered the specified area.

However, in the conventional gate apparatus, information necessary for judging the incoming of the card owner is insufficient. Thus, it is only supposed that the card owner has entered the specified area, and it is not surely recognized that the card owner has entered. In addition, in order to monitor the incoming and outgoing of the card owner, it is necessary to provide separate gate apparatuses on the entrance side and exit side, causing problems with respect to the location and cost for installation of the gate apparatuses.

SUMMARY OF THE INVENTION

The present invention has been made in consideration of the above circumstances, and its object is to provide a gate apparatus using an ID information recording medium, making it possible to surely recognize the incoming and outgoing of a person or an object to and from a specified area with use of a single gate apparatus.

According to a first aspect of the invention, in order to achieve the object, there is provided a gate apparatus for controlling a lock provided on a door, on the basis of a read result obtained by reading an inserted ID information storage medium, said apparatus comprising: a convey path, formed between a front portion and a rear portion of the gate apparatus, for insertion and discharge of the storage medium; convey means for conveying the storage medium along the convey path; insertion-side detecting means for detecting an insertion side from which the storage medium is inserted; discharge-side detecting means for detecting a discharge side to which the storage medium is discharged; door state detecting means for detecting the open/closed state of the door; and control means for controlling the convey means on the basis of detection results obtained by the insertion-side detecting means and the door state detecting means, and discharging the inserted storage medium from either the front portion or the rear portion of the gate apparatus.

According to a second aspect of the invention, there is provided a gate apparatus for controlling a lock provided on a door, on the basis of a read result obtained by reading an inserted ID information storage medium, said apparatus comprising: a convey path, formed between first and second input/output ports provided at a front portion and a rear portion of the gate apparatus, for insertion and discharge of the storage medium from through both said ports; discharge instruction means, provided at the front and rear portions of the gate apparatus, for providing an instruction for discharge of the storage medium; convey means for conveying the storage medium; insertion-side detecting means for detecting an insertion side from which the storage medium is inserted; door state detecting means for detecting the open/closed state of the door; and control means for controlling the convey means on the basis of the detection results obtained by the insertion-side detecting means and the door state detecting means and the instruction provided by the discharge instruction means, and discharging the inserted storage medium from either the front portion or the rear portion of the gate apparatus.

According to a third aspect of the invention, there is provided a gate apparatus comprising: convey means for conveying an ID information storage card formed to penetrate from an input side to an output side of a specified area where entering/exiting of a person is to be monitored; stopping means, provided midway along a convey path of said convey means, for stopping the card which has been inserted; read/write means for reading/writing ID information including information on the insertion side of the card stopped by the stopping means; instruction means, provided at the input side and the output side, for instructing the direction of discharge of the card stopped by the stopping means; and discharge means for discharging the card in the direction indicated by said instruction means.

According to a fourth aspect of the invention, there is provided a gate apparatus comprising: convey means for conveying an ID information storage card formed to penetrate from an input side to an output side of a specified area where entering/exiting of a person is to be monitored; stopping means, provided midway along a convey path of said convey means, for stopping the card which has been inserted; instruction means, provided at the input side and the output side, for instructing the direction of discharge of the card stopped by the stopping means; discharge means for discharging the card in the direction indicated by said instruction means; and determining means for determining whether a user has entered, has exited, or has suspended the action of entering or exiting, on the basis of the direction of discharge by the discharge means.

According to the apparatus of the first aspect, when the owner of the storage medium enters, he/she inserts the storage medium from the front side of the apparatus. Then, the insertion-side detecting means detects that the storage medium has been inserted from the front side of the apparatus, and the stored data of the storage medium is read out. Based on the read result, the lock of the door is deactivated. When the storage medium owner opens the door and closes it, the lock is activated. The door state detecting means detects that the door was opened and then closed. Based on the detection results of the insertion-side detecting means and door state detecting means, the control means detects that the storage medium owner has entered, controls the convey means, and discharges the storage medium from the rear side of the apparatus. If the door is not opened after the lock is deactivated, the control means continues to activate the lock. The control means determines that the storage medium owner has not entered, controls the convey means, and discharges the storage medium from the front side of the apparatus. These operations are performed when the storage medium owner exits. As stated above, since the storage medium can be inserted and discharged on either of the front and rear sides of the apparatus, entering/exiting can be monitored with a single gate apparatus. Since the discharge direction of the storage medium is determined on the basis of the detection results of the insertion-side detecting means and door state detecting means, entrance/exit information can exactly be obtained.

According to the apparatus of the second aspect, when the storage medium owner enters, he/she inserts the storage medium from the front side of the apparatus. Then, the insertion-side detecting means detects that the storage medium has been inserted from the front side of the apparatus, and the stored data of the storage medium is read out. Based on the read result, the lock of the door is deactivated. When the storage medium owner opens the door and closes it, the lock is activated. The door state detecting means detects that the door was opened and then closed. The storage medium owner who has entered instructs the detection of the storage medium by operating the discharge instruction means provided on the rear of the apparatus. Based on the detection results of the insertion-side detecting means and door state detecting means and the instruction by the discharge instruction means, the control means detects that the storage medium owner has entered, controls the convey means, and discharges the storage medium from the rear side of the apparatus. If the storage medium owner did not enter after he/she opened and closed the door, the discharge of the storage medium is instructed by the discharge instruction means provided on the front side of the apparatus. The control means determines that the storage medium owner has not entered, controls the convey means, and discharges the storage medium from the front side of the apparatus. These operations are performed when the storage medium owner exits. As stated above, since the storage medium can be inserted and discharged on either of the front and rear sides of the apparatus, entering/exiting can be monitored with a single gate apparatus. Since the discharge direction of the storage medium is determined on the basis of the detection results of the insertion-side detecting means and door state detecting means and the instruction by the discharge instruction means, entrance/exit information can exactly be obtained.

According to the apparatus of the third aspect of the invention, when the owner of the ID information storage medium enters a specified area, he/she inserts the storage medium from the outdoor side when the owner exits, he/she inserts the storage medium from the indoor side. The stopping means stops the inserted ID information storage medium midway along the convey path of the convey means. The read/write means performs a read/write operation for reading/writing information from/in the storage medium when the storage medium owner has entered and is present on the indoor side or when he/she has suspended the action of exiting and remains on the indoor side, the direction of discharge of the ID information storage medium is instructed by the indoor-side instruction means when the storage medium owner has exited and is present on the outdoor side or when he/she has suspended the action of entering and remains on the outdoor side, the direction of discharge of the ID information storage medium is instructed by the outdoor-side instruction means. The discharge means discharges the ID information storage medium in the direction instructed by the instruction means. As stated above, the ID information storage medium can be inserted and discharged from either of the indoor side and outdoor side of the apparatus, entering/exiting can be monitored with a single apparatus. Since information is read from and written in the ID information storage medium by the read/write means and the storage medium is discharged in accordance with the instruction by the instruction means, entering/exiting information can exactly be obtained.

According to the apparatus of the fourth aspect of the invention, when the owner of the ID information storage medium enters a specified area, he/she inserts the storage medium from the outdoor side. When the owner exits, he/she inserts the storage medium from the indoor side. The stopping means stops the inserted ID information storage medium midway along the convey path of the convey means. When the storage medium owner has entered and is present on the indoor side or when he/she has suspended the action of exiting and remains on the indoor side, the direction of discharge of the ID information storage medium is instructed by the indoor-side instruction means when the storage medium owner has exited and is present on the outdoor side or when he/she has suspended the action of entering and remains on the outdoor side, the direction of discharge of the ID information storage medium is instructed by the outdoor-side instruction means. The discharge means discharges the ID information storage medium in the direction instructed by the instruction means. The determining means determines whether the owner has entered, has exited, or has suspended the action of entering or exiting, on the basis of the direction of discharge by the discharge means. As stated above, the ID information storage medium can be inserted and discharged from either of the indoor side and outdoor side of the apparatus, entering/exiting can be monitored with a single apparatus. Since the ID information storage medium is discharged in accordance with the instruction by the instruction means and it is determined whether the owner has entered, has exited, or has suspended the action of entering or exiting, on the basis of the direction of discharge by the discharge means, entering/exiting information can exactly be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be described in detail with reference to the accompanying drawings.

Figure 1:
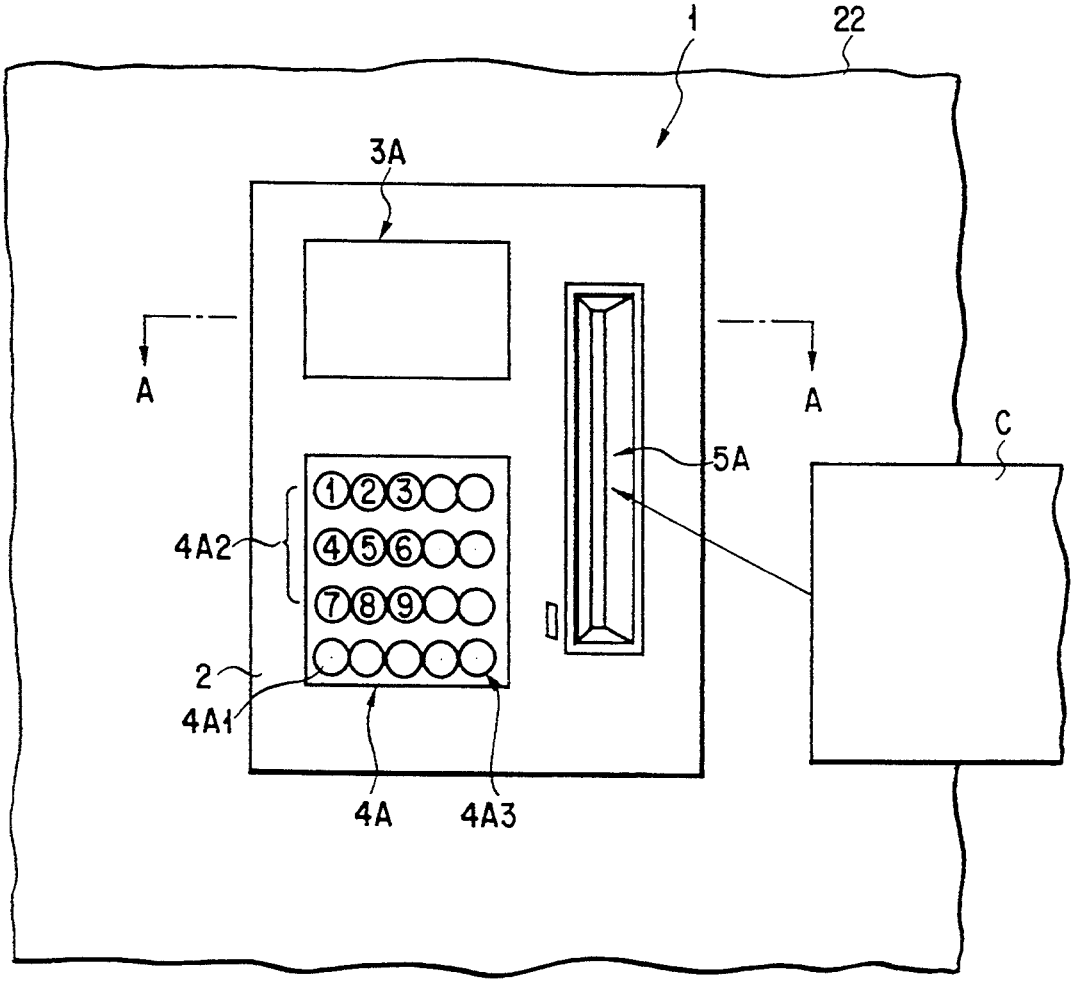
FIG. 1 is a plan view showing a gate apparatus according to a first embodiment of the present invention.
Figure 2:
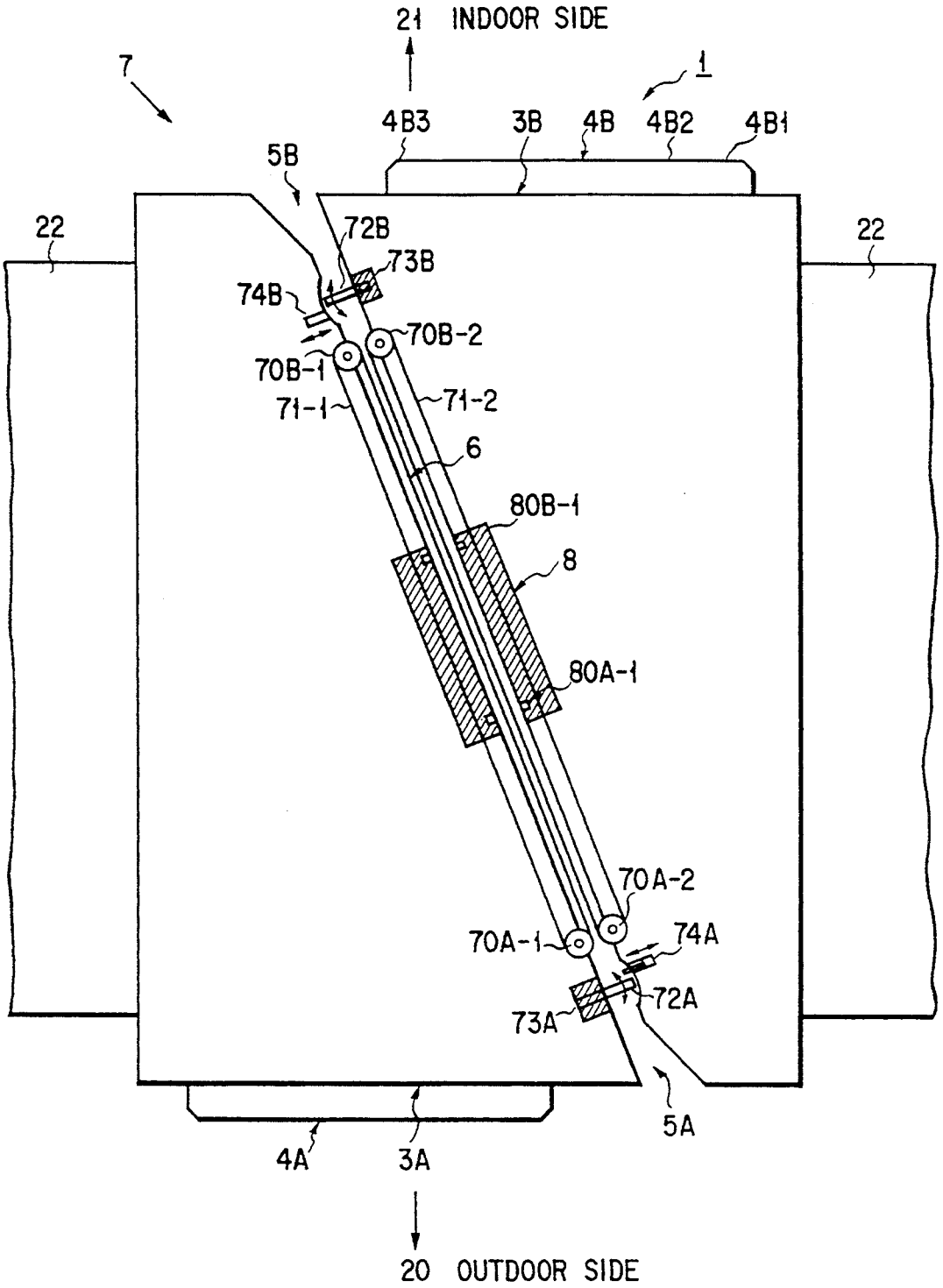
FIG. 2 is a cross-sectional view taken along line A—A in FIG. 1.

FIG. 1 is a plan view showing a gate apparatus according to a first embodiment of the present invention, and FIG. 2 is a cross-sectional view taken along line A—A in FIG. 1.

As is shown in FIG. 1, the gate apparatus according to the first embodiment comprises a substantially rectangular-parallelepipedic casing 2 and a buzzer (not shown). The front face of the casing 2 is provided with an outdoor-side display unit 3A such as a liquid crystal display (LCD), an outdoor-side operation unit 4A with various keys including an LED 4A1, number keys 4A2 and a discharge indication button 4A3, and an outdoor-side card entrance/exit port 5A in/from which an IC card or storage medium C is inserted/discharged. The rear face of the casing 2, too, is provided with a similar indoor-side display unit 3B, indoor-side operation unit 4B and indoor-side card entrance/exit port 5B. In addition, as is shown in FIG. 2, the gate apparatus 1 includes a card convey path 6 for connecting the card entrance/exit ports 5A and 5B formed at the front and rear faces of the casing 2. The card convey path 6 is provided with a card convey unit 7 functioning as means for conveying the IC card C, and a contact unit 8 for communication with the IC card C.

The LEDs 4A1 and 4B1 mounted on the operation units 4A and 4B indicate the usable state, for example, when they are turned off, and indicate the non-usable state when they are turned on.

As is shown in FIG. 2, the convey unit 7 comprises a pair of pulleys 70A-1 and 70B-1, a pair of pulleys 70A-2 and 70B-2, convey belts 71-1 and 71-2 passed over these two pairs of pulleys on both sides of the convey path 6, and a motor for driving, e.g. the pulleys 70A-1 and 70A-2. The convey unit 7 comprises, on the outdoor side 20 of the card convey path 6, an outdoor-side rotatable shutter 72A, an outdoor-side card sensor 73A for sensing insertion/discharge of the card C on the basis of the rotational motion of the shutter 72A, and an outdoor-side stopper 74A for restricting rotational motion of the outdoor-side shutter 72A by a projecting operation performed by a solenoid (not shown). Similarly, an indoor-side shutter 72B, an indoor-side card sensor 73B and an indoor-side stopper 74B are provided on the indoor side 21 of the card convey path 6.

Figure 3:
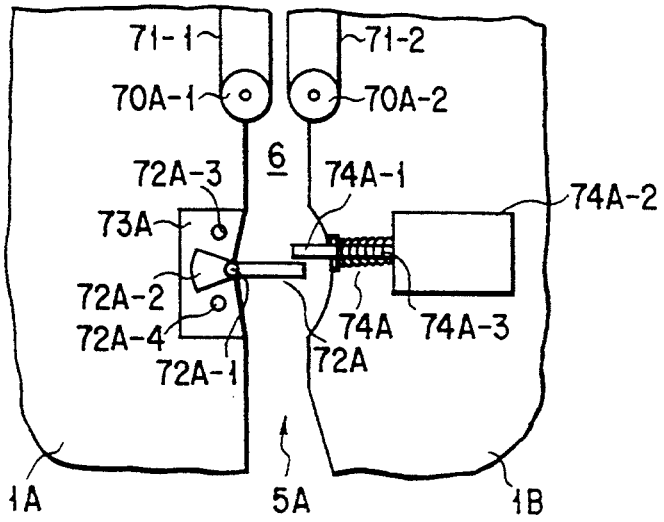
FIG. 3 is a plan view of an insertion control unit according to the first embodiment.

Now referring to FIG. 3, the shutter 72A, card sensor 73A and stopper 74A on the outdoor side 20 will be described in greater detail. The shutter 72A is provided on the outside and the stopper 74A is provided on the inside in the card passage between the port 5A and the card convey path 6.

The shutter 72A is rotatably attached to the body 1A via a pin 72A-1, so that a shutter plate 72A-2 is rotatable along with the shutter 72A. A coil spring (not shown) is provided between the pin 72A-1 and shutter 72A, so that the shutter 72A may always be kept at the illustrated position unless an external force is applied.

A pair of photosensors 72A-3 and 72A-4, which function as parts of thee card sensor 73A, are disposed on both sides of the shutter plate 72A-2 at a level lower than the shutter plate 72A-2. When the IC card C is discharged from the card convey path 6 towards the port 5A, the shutter 72A is moved towards the port 5A, and the shutter plate 72A-2 is located above the photosensor 72A-3. Thus, an output signal is obtained from the photosensor 72A-3. When the IC card C is inserted in the card convey path 6 from the port 5A, the shutter 72A is moved towards the card convey path 6 and an output signal is obtained from the photosensor 72A-4.

The stopper 74A comprises a stopper pin 74A-1, a solenoid 74A-2 for driving the pin 74A-1, and a return spring 74A-3 for returning the stopper pin 74A-1 to the retreated position thereof when the solenoid 74A-2 is activated, the stopper pin 74A-1 projects to the illustrated position against the force of the return spring 74A-3. At this position, the shutter 72A can rotate only towards the port 5A and cannot do so towards the card convey path 6. Thus, the IC card C can be discharged but cannot be inserted.

The contact unit 8 will now be described with reference to FIGS. 4 to 7.

Figure 4:
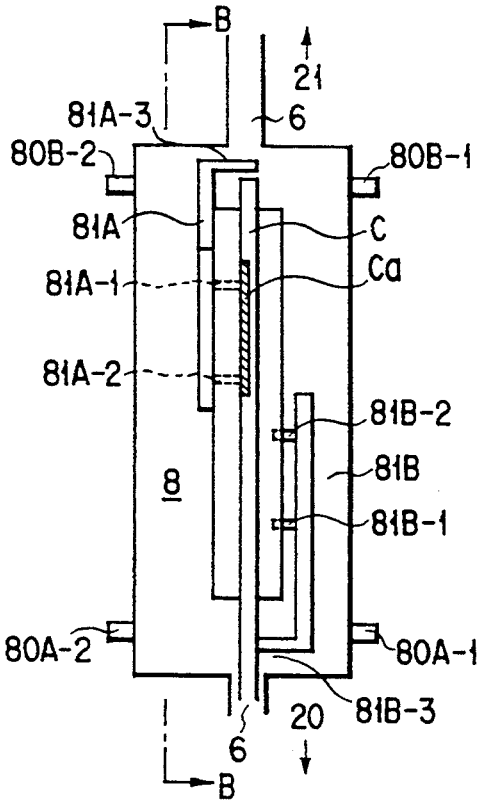
FIG. 4 is a side view of a contact unit according to the first embodiment.
Figure 5:
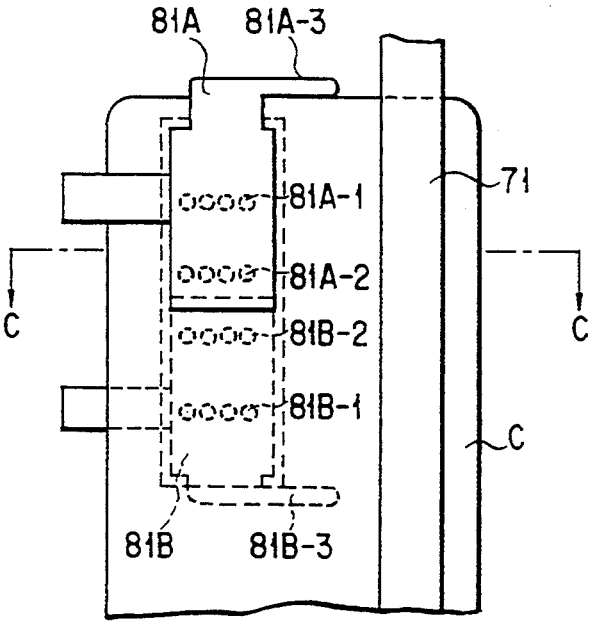
FIG. 5 is a plan view of the contact unit of FIG. 4, as viewed in a direction of B—B in FIG. 4.

In FIGS. 4 and 5, the contact unit 8 comprises card positioning sensors 80A-1 and 80A-2 for determining the stop position of the IC card C on the outdoor side 20, card positioning sensors 80B-1 and 80B-2 for determining the stop position of the IC card C on the indoor side 21, and contact plates 81A and 81B. The contact plate 81A has contact pins 81A-1 and 81A-2 which are put in contact with a contact portion Ca of the IC card C at the illustrated position, and also has a leg portion 81A-3. When the contact portion Ca of the IC card C is in contact with the contact pins 81A-1 and 81A-2, a tip portion of the leg portion 81A-3 is disengaged from a tip portion of the IC card C and projects forwards. In this state, the other tip portion of the IC card C extends along the card convey path 6 from the leg portion 81B-3 of the other contact plate 81B, and a tip portion of the leg portion 81B-3 abuts on the surface of the IC card C. As a result, the contact pins 81B-1 and 81B-2 do not come into contact with the IC card C.

Figure 6:
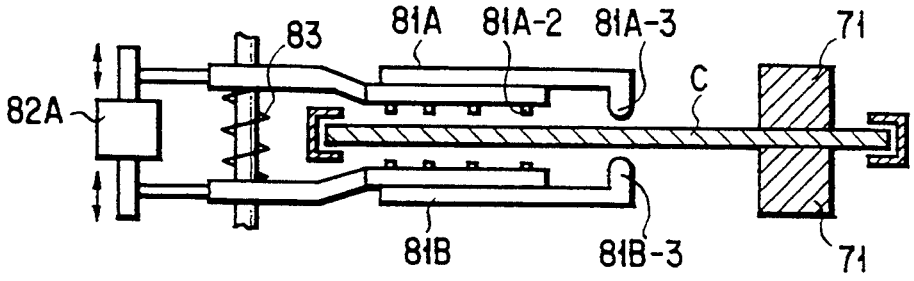
FIG. 6 is a cross-sectional view taken along line C—C in FIG. 5, showing the state of the contact unit before the contact operation is performed.
Figure 7:
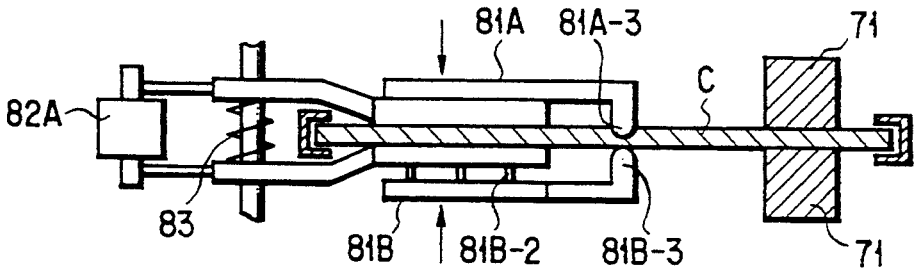
FIG. 7 is a cross-sectional view taken along line C—C in FIG. 5, showing the state of the contact unit after the contact operation has been performed.

The above states are shown in FIGS. 6 and 7.

When the IC card C is inserted from the indoor side 21, the contact portion Ca of the IC card C is put in contact with the contact pins 81B-1 and 81B-2. The leg portion 81A-3 is put in contact with the IC card C and not put in contact with the contact pin 81A-1 or 81A-2.

The card positioning sensors 80A-1, 80A-2, 80B-1 and 80B-2 are provided for positioning in putting the card C into contact with the contact pins 81A-1 and 81A-2 or contact pins 81B-1 and 81B-2. As is shown in FIG. 4, when the contact pins 81A-1 and 81A-2 are put in contact with the contact portion Ca of the card C, power can be supplied to the card C to enable a CPU 9 (described later) and the IC card C to communicate with each other.

Figure 8:
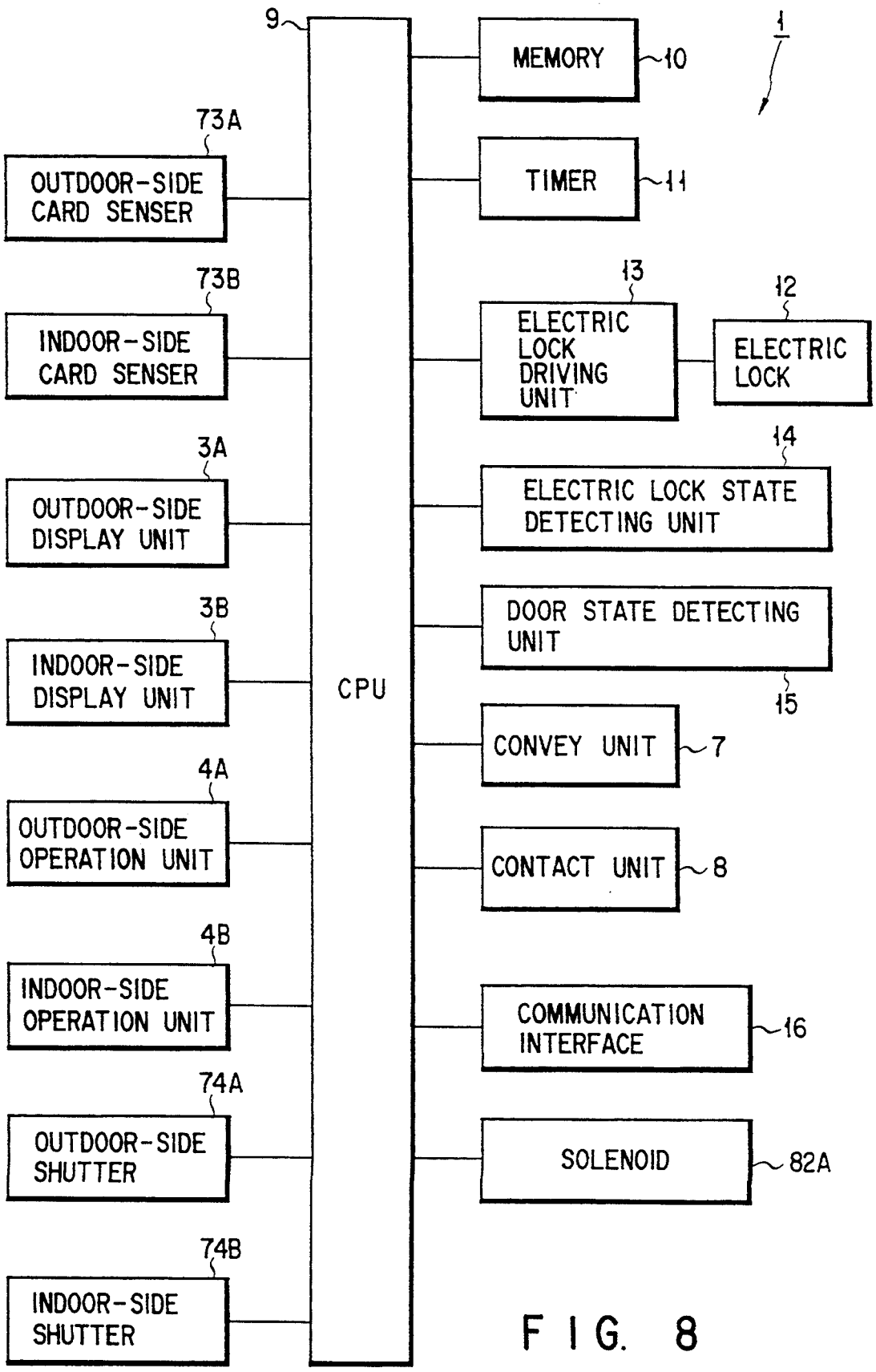
FIG. 8 is a block diagram showing a control system according to the first embodiment.

FIG. 8 is a block diagram showing a control system of the apparatus 1 according to the first embodiment.

The apparatus 1 has a CPU 9 serving both as read/-write means and determining means for controlling the parts of the apparatus 1, performing an information read/write operation on the card C, and determining whether the user has entered or exited or whether the user's action of entering/exiting has been suspended. The CPU 9 is connected to a memory 10 pre-storing a personal information list, etc., a timer 11 for counting a predetermined time under the control of the CPU 9, the outdoor-side card sensor 73A, the indoor-side card sensor 73B, the outdoor-side display unit 3A, the indoorside display unit 3B, the outdoor-side operation unit 4A, the indoor-side operation unit 4B, the convey unit 7, the contract unit 8, an electric lock driving unit 13 for activating/deactivating an electric lock 12, an electric lock state detecting unit 14 for detecting the activated/deactivated state of the electric lock 12, a door state detecting unit 15 for detecting the open/-closed state of a door 23, and a communication interface 16 for communication with an external apparatus (not shown).

Figure 9:
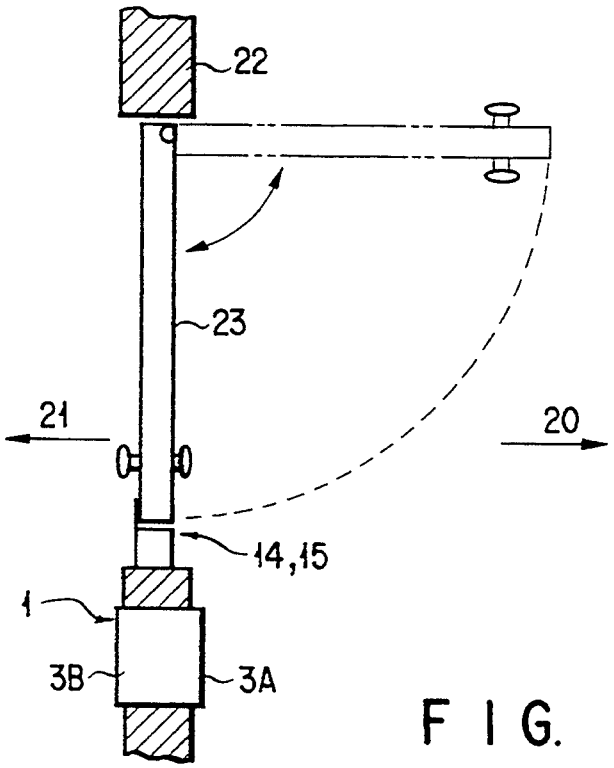
FIG. 9 shows an example of installation according to the first embodiment.
Figure 10:
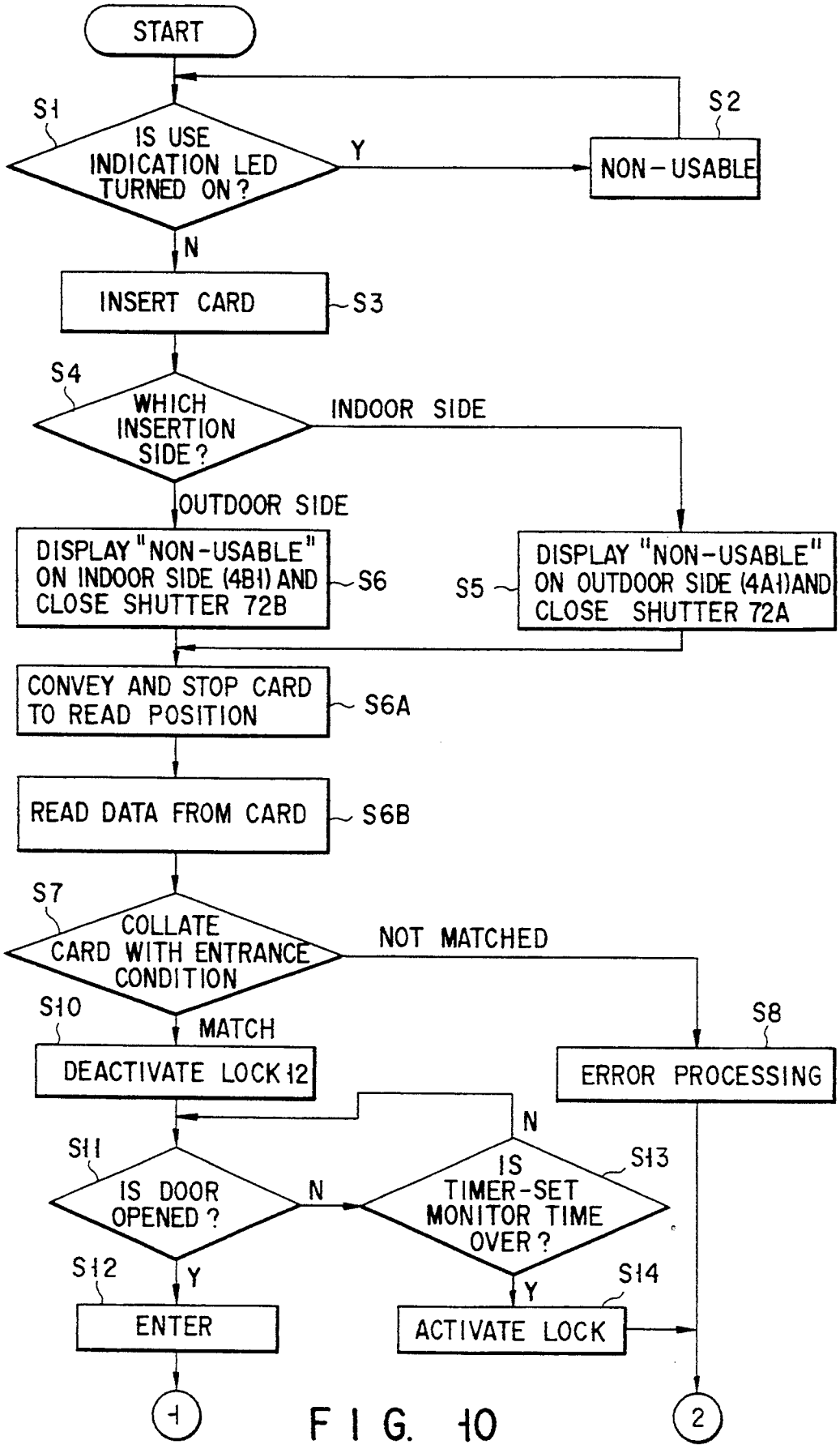
FIG. 10 is a flow chart illustrating the operation of the first embodiment.
Figure 11:
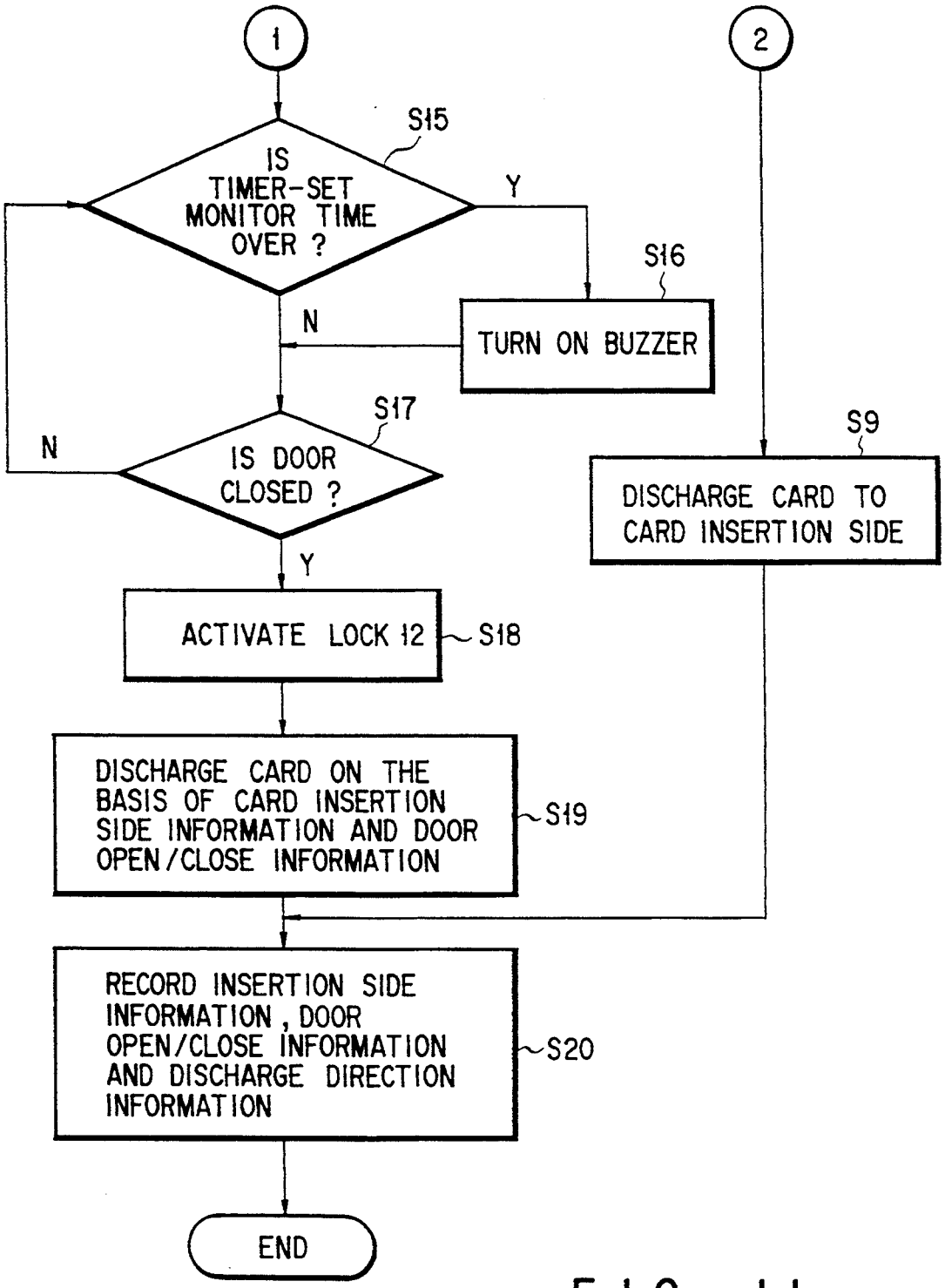
FIG. 11 is a flow chart illustrating the operation of the first embodiment.

The operation of the apparatus of the first embodiment will now be described with reference to FIGS. 9 to 11. FIG. 9 shows an example of installation of the apparatus of the first embodiment, and FIGS. 10 and 11 are flow charts illustrating the operation of this apparatus.

As is shown in FIG. 9, the apparatus 1 is mounted on and within a wall 22, which separates the outdoor side 20 and indoor side 21, such that the outdoor-side display unit 3A, etc. face the outdoor side 20. A person (e.g. a worker) who intends to enter the inside has a personal IC card in which personal information (ID information), etc. is pre-stored.

At first, the normal operation of the apparatus 1 will now be described. The worker with the IC card C judges whether the apparatus 1 is usable or not, by viewing the LED 4A1 of the outdoor-side operation unit 4A (S1). When the LED 4A1 is turned on, the apparatus 1 cannot be used since it is now being used (S2). When the LED 4A1 is turned off, the worker can use the apparatus 1 and inserts the card C into the outdoor-side card input/output port 5A (S3). In this case, the stopper 74A is not projected, and the outdoor-side shutter 72A is pushed by the inserted card C. The shutter 72A rotates inwards on the pin 72A-1. As a result, the photosensor 72A-4 of the outdoor-side card sensor 73A is covered by the shutter plate 72A-2, and the photosensor 72A-4 senses the insertion of the card C through the port 5A, on the basis of the rotation of the shutter 72A. Based on the sensed result of the outdoor-side card sensor 73A, the CPU 9 recognizes that the card C has been inserted from the outdoor side 20 (S4). In this case, since the card C has been inserted from the outdoor side 20, the indoor-side display unit 4B1 is operated to indicate the non-usable state, and the indoor-side stopper 74B is projected to restrict rotational motion of the indoor-side shutter 72B. Thus, insertion of the card C from the indoor side 21 is prevented (S6).

When the card C is inserted from the indoor side 21, the CPU 9 operates the outdoor-side display unit 4A1 to indicate the non-usable state. In addition, the CPU 9 controls the motor (not shown) to project the outdoor-side stopper 74A, thereby restricting rotational motion of the outdoor-side shutter 72A. Thus, insertion of the card C from the outdoor side 20 is prevented (S5).

Since the insertion of the card C from the outdoor side 20 has been sensed on the basis of information from the outdoor-side card sensor 7BA, the CPU 9 drives the convey unit 7 and runs the belts 71-1 and 71-2. Thus, the card C is conveyed to the contact unit 8 (S6A). The card C is conveyed by the belts 71-1 and 71-2. When a rear end portion of the card C has passed a front portion of the shutter 72A, the shutter 72A restores to the initial position. The sensor 72A-4 senses the restoration of the card C and tells the CPU 9 that the card C has been inserted in the gate apparatus 1. The CPU 9 drives the outdoor-side stopper 74A and projects it into the convey path 6. Thus, insertion of another card C is prevented.

When the card C has been conveyed to the position illustrated in FIG. 4, the positioning sensors 80B-1 and 80B-2 detect the front end portion of the card C and the operation of the convey unit 7 is stopped. Then, the CPU 9 drives the solenoid 82A, as shown in FIGS. 6 and 7, so that the contact plates 81A and 81B are pressed on the card C against the force of the spring 83. As a result, the contact pins 81A-1 and 81A-2 of contact plate 81A are put in contact with the contact portion Ca of the card C, and power is supplied to the card C and personal information, etc. is read from the card C. The read information is collated with an entrance condition stored in the memory 10 (S7). If the read information matches with the entrance condition, the electric lock driving unit 13 is controlled and the electric lock 12 is deactivated (S10). The worker opens the door 23 (S11) and enters (S12). In this case, the door state detecting unit 15 detects the opening of the door 23. The CPU 9 monitors count information from the timer 11 set on the basis of the detection of the open state by the door state detecting unit 15 (S15). If the door 23 is closed within a predetermined time period (S17), the CPU 9 controls the electric lock driving unit 13 to activate the electric lock 12 (S18). The CPU 9 deactivates the solenoid 82A, releases the card C, and retreats the card stopper 74B on the indoor side 21. Based on both card insertion information and door open/closed state information, the convey unit 7 is controlled and the card C is conveyed. Thus, the card C is discharged from the indoor-side card input/output port 5B to the indoor side 21 (S19). When the card C has come to the port 5B, the shutter 72B is turned towards the indoor side 21 by the front end of the card C. When the card C is pulled out, the shutter 72B is returned. Through the series of these operations, the card sensor 73B can sense the discharge of the card C.

The obtained information such as card insertion side information, door opening/closing information and discharge direction information is recorded in the memory 10 (S20). The worker receives the card C on the indoor side 21. Based on the information to the effect that the card C has been discharged from the indoor side card input/output port 5B, the CPU 9 retreats the shutter stopper 74A of the outdoor side 20.

The operation in the abnormal mode will now be described. When the read information does not match with the entrance condition in step S7, the CPU 9 performs error processing (S8) and controls the convey unit 7. Thus, the card C is discharged from the outdoor-side card port 5A located on the card insertion side (S9). The control routine advances to step S20. If the door 23 is not opened in step S11, the CPU 9 monitors count information from the timer 11 set on the basis of the detection of the deactivated state of the electric lock state detecting unit 14. If the door 23 is not opened within a predetermined time period (S13), the CPU 9 controls the electric lock driving unit 13, once again, to activate the electric lock 12 (S14). Similarly with the above-described operation, the convey unit 7 is controlled and the card C is discharged from the outdoor-side card input/output port 5A on the card insertion side (S9). On the other hand, if the door 23 is opened in step S15 and is not closed within a predetermined time period, the CPU 9 monitors count information from the timer 11 set on the basis of the detection of the open state by the door state detecting unit 15. If the opened door 23 remains open for a predetermined time period or more, the buzzer is activated to request the worker to close the door 23 (S16). If the door 23 is closed (S17), the control routine advances to step S18.

As has been described above, in the case where the card C is inserted and the normal processing is completed, the card C is discharged to the opposite side (indoor side 21) to the card insertion side (outdoor side 20). Thus, the worker inevitably comes to the opposite side (indoor side 21), and the entering/exiting can be exactly monitored. In addition, since the card C is not discharged to the opposite side until the door 23 has been opened and closed, the card C can be discharged in accordance with the movement of the worker. Compared to the prior art, many information items necessary for monitoring the entering/exiting, i.e. card insertion side information, door opening/closing information and card discharge direction information, can be obtained. For example, when the obtained information indicates that the card has been inserted from the outdoor side 20, the door 23 has been closed and the card has been discharged to the outdoor side 20, it is found that the worker has not entered since the door 23 remains closed even if the card C has been inserted. On the other hand, when the obtained information indicates that the card has been inserted from the outdoor side 20, the door has been opened and closed and the card has been discharged to the indoor side 21, it is found that the worker has entered because the card C was inserted, the door 23 was opened, the worker entered and the door 23 was closed.

A gate apparatus according to a second embodiment of the invention will now be described. According to the apparatus 1 of the second embodiment, the CPU 9 determines, only when a password has been input by the card owner by means of a specified key or number keys functioning as indication means of the operation unit 4A, 4B, that the card owner is present on the side where the password has been input, and the CPU 9 automatically discharges the card C to the side where the password has been input. The second embodiment is the same as the first embodiment in the other respects.

Figure 12:
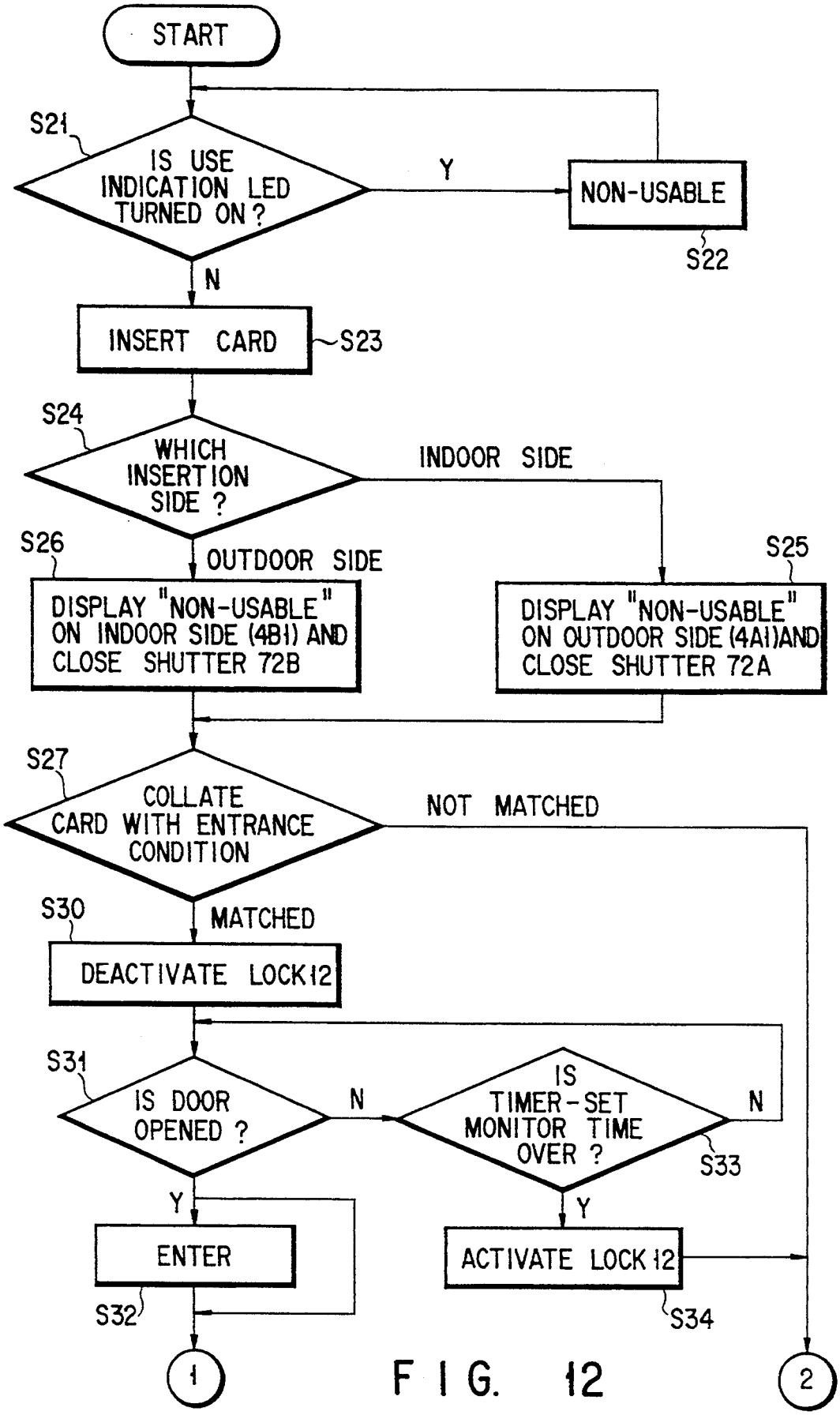
FIG. 12 is a flow chart illustrating the operation of a first embodiment of the invention.
Figure 13:
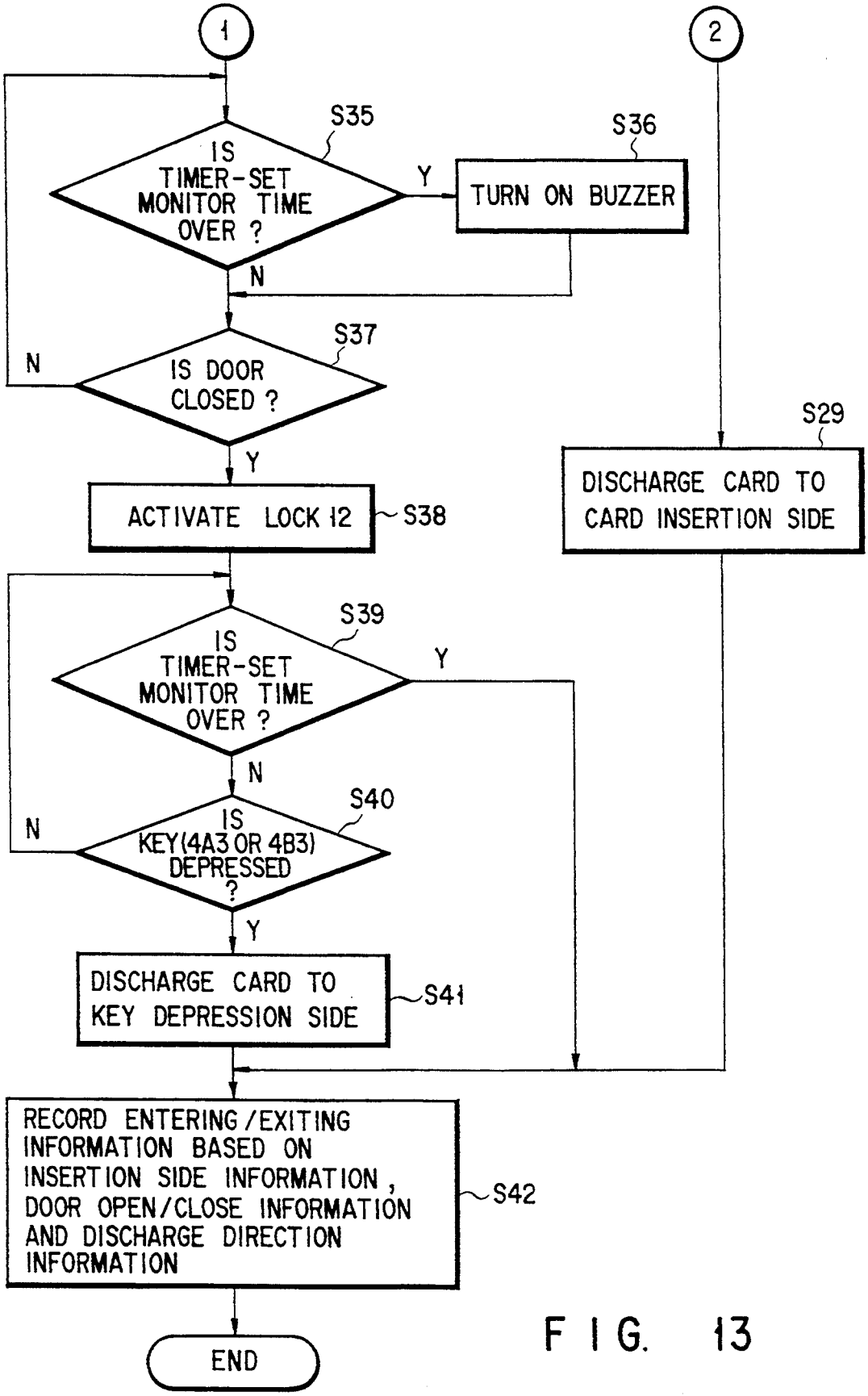
FIG. 13 is a flow chart illustrating the operation of the second embodiment.

The operation of the second embodiment having this structure will now be described with reference to FIGS. 12 and 13. FIGS. 12 and 13 are flow charts illustrating the operation of the second embodiment.

At first, the normal operation will now be described. The worker with the IC card C judges whether the apparatus 1 is usable or not, by viewing the LED 4A1, as in the first embodiment (S21). When the LED 4A1 is turned on, the apparatus 1 cannot be used (S22). When the LED 4A1 is turned off, the worker can use the apparatus 1 and inserts the card C into the outdoor-side card input/output port 5A (S23). As in the first embodiment, the CPU 9 recognizes the card insertion side (S24). When the card C was inserted from the indoor side 21, the CPU 9 operates the outdoor-side display unit 4A1 to indicate the non-usable state, and close shutter 72A to prevent the card C from being inserted from the outdoor side 20, as in the first embodiment (S25). In this embodiment, the card C was inserted from the outdoor-side card port 5A. Thus, the indoor-side display unit 4B1 indicates the non-usable state and, like the first embodiment, the shutter 72B is closed, so that insertion of the card C from the indoor side 21 is prohibited (S26). As in the first embodiment, personal information, etc. is read from the card C and the read information is collated with the entrance condition stored in the memory 10 (S27). When the read information matches with the entrance condition in step S27, the electric lock driving unit 1B is controlled to deactivate the electric lock 12 (S30). The worker opens the door 23 (S31) and enters (S32). In this case, the door state detecting unit 15 detects the opening of the door 23. The CPU 9 monitors count information from the timer 11 set on the basis of the detection of the open state by the door state detecting unit 15 (S35). If the door 23 is closed within a predetermined time period (S37), the CPU 9 controls the electric lock driving unit 13 to activate the electric lock 12 (S38). The CPU 9 monitors count information from the timer 11 set on the basis of the detection of the lock activated state by the electric lock state detecting unit 14 (S39). If the number key 4A2 or 4B2 for inputting the password is depressed within a predetermined time period (S40), the CPU 9 controls the convey unit 7 so as to discharge the card C from the port 5B, on the side of which the number key associated with the password was depressed (S41). The memory 10 stores entering-/exiting information on the basis of the insertion side information, door opening/closing information and discharge direction information (S42). The worker receives the card C on the side where the password input key 4A2 or 4B2 was depressed.

Next, the operation in the abnormal mode will now be described. When the read information does not match with the entrance condition in step S27, the CPU 9 controls the convey unit 7 to discharge the card C from the outdoor-side card input/output port 5A located on the card insertion side (S29), and the control routine advances to step S42 when the door 23 is not opened in step S31, the CPU 9 monitors count information supplied from the timer 11 set on the basis of the detection of the lock deactivation state by the electric lock state detecting unit 14. If it is determined that the door 23 is not opened for a predetermined time period (SBB), the electric lock driving unit 13 is controlled once again to activate the electric lock 12 (S34), and similarly with the aforementioned operation, the convey unit 7 is controlled to discharge the card C from the outdoor-side card port 5A located on the card insertion side (S29). If the door 23 is opened in step S35 but not closed within a predetermined time period, the CPU 9 monitors count information from the timer 11 set on the basis of the detection of the open state by the door state detecting unit 15. If it is determined that the opened door remains open for a predetermined time period or more, the buzzer is turned on to request the worker to close the door 23 (S36). If the door 23 is closed (S37), the control routine advances to step S38. If the password input key 4A2 or 4B2 is not depressed for a predetermined time period or more in step S39, the CPU 9 monitors count information supplied from the timer 11 set on the basis of the detection of the lock activation state by the electric lock state detecting unit 14. If it is determined that the password input key 4A2 or 4B2 is not depressed for a predetermined time period or more, the control routine advances to step S42.

In the first embodiment, when the card C has been inserted on the outdoor side 20, the door 23 has been opened and closed and the card C has been discharged to the indoor side 21, it can be guessed that the worker entered and received the card C. It is possible, however, that the worker did not enter. In this case, according to the second embodiment, the entering of the worker can exactly be confirmed on the basis of the depression of the password input key 4B2 on the indoor side 21.

A gate apparatus according to a third embodiment of the invention will now be described. In the third embodiment, the operation units 4A and 4B are provided with discharge buttons 4A3 and 4B3 as discharge indication means. When the discharge button 4A3 of the outdoor-side operation unit 4A is depressed, the card C is discharged to the outdoor side 20 by the CPU 9. On the other hand, when the discharge button 4B3 of the indoor-side operation unit 4B is depressed, the card C is discharged to the indoor side 21 by the CPU 9. The third embodiment is the same as the first embodiment in the other respects.

Figure 14:
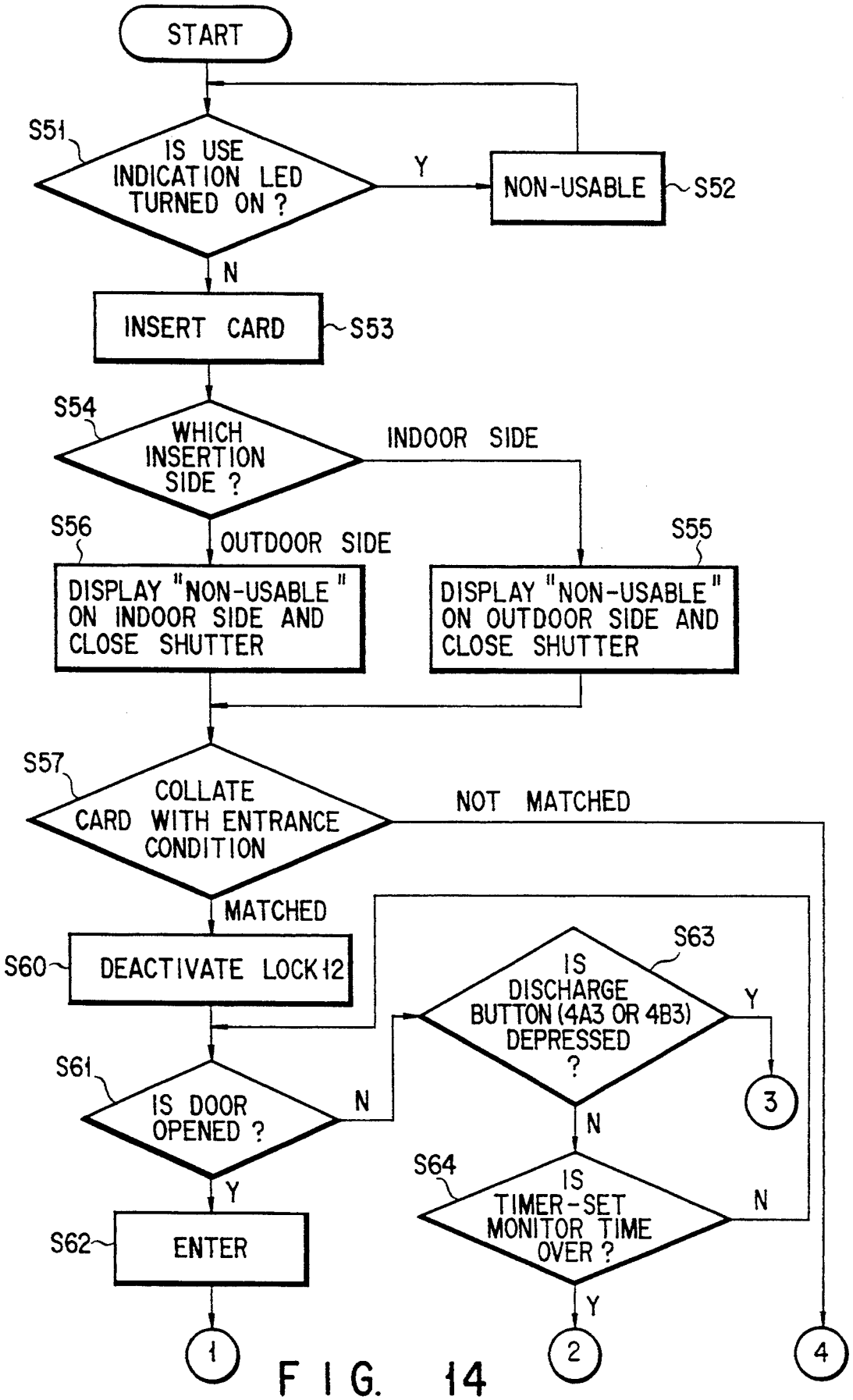
FIG. 14 is a flow chart illustrating the operation of a third embodiment of the invention.
Figure 15:
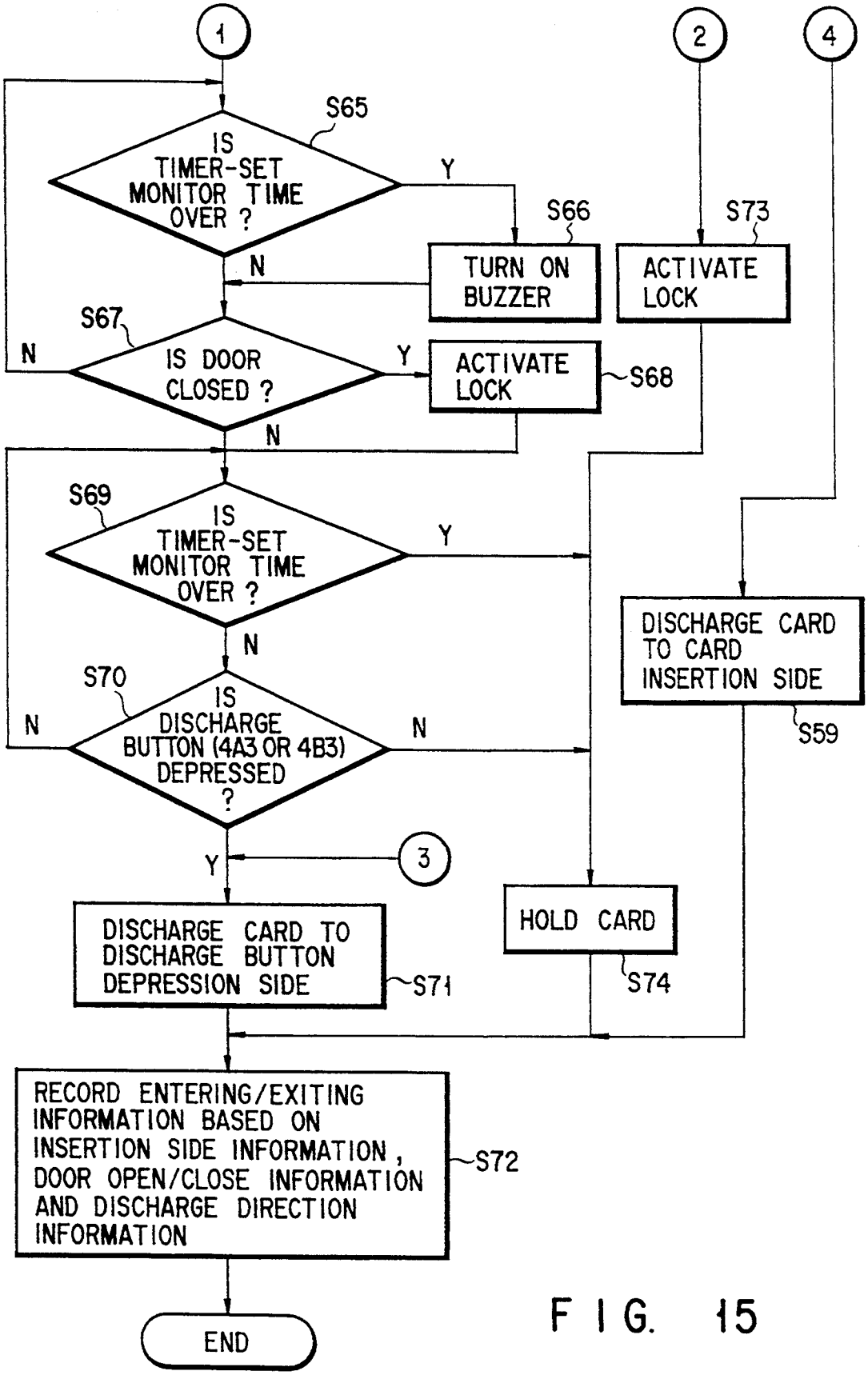
FIG. 15 is a flow chart illustrating the operation of the third embodiment.

The operation of the third embodiment having the above structure will now be described with reference to FIGS. 14 and 15. FIGS. 14 and 15 are flow charts illustrating the operation of the third embodiment.

The normal operation will now be described. The worker with the IC card C judges whether the apparatus 1 is usable or not, by viewing the LED 4A1, as in the first embodiment (S51) when the LED 4A1 is turned on, the apparatus 1 cannot be used (S52). When the LED 4A1 is turned off, the worker can use the apparatus 1 and inserts the card C into the outdoor-side card input/output port 5A (S53). As in the first embodiment, the CPU 9 recognizes the card insertion side (S54). When the card C was inserted from the indoor side 21, the CPU 9 operates the outdoor-side display unit 3A to indicate the non-usable state, and prevents the card C from being inserted from the outdoor side 20, as in the first embodiment (S55). In this embodiment, the card C was inserted from the outdoor-side card port 5A. Thus, the indoor-side display unit 3B indicates the non-usable state and, like the first embodiment, insertion of the card C from the indoor side 21 is prohibited (S56). As in the first embodiment, personal information, etc. is read from the card C and the read information is collated with the entrance condition stored in the memory 10 (S57) when the read information matches with the entrance condition in step S57, the electric lock driving unit 13 is controlled to deactivate the electric lock 12 (S60). The worker opens the door 23 (S61) and enters (S62). In this case, the door state detecting unit 15 detects the opening of the door 23. The CPU 9 monitors count information from the timer 11 which has been set on the basis of the detection of the open state by the door state detecting unit 15 (S65). If the door 23 is closed within a predetermined time period (S67), the CPU 9 controls the electric lock driving unit 13 to activate the electric lock 12 (S68). The CPU 9 monitors count information from the timer 11 which has been set on the basis of the detection of the lock activated state by the electric lock state detecting unit 14 (S69). If the discharge key 4A3 or 4B3 is depressed within a predetermined time period (S70), the CPU 9 controls the convey unit 7 so as to discharge the card C from the port 5B (S71). The memory 10 stores entering/exiting information on the basis of the insertion side information, door opening/closing information and discharge direction information (S72). The worker receives the card C on the side where the discharge button 4B3 was depressed.

Next, the operation in the abnormal mode will now be described. When the read information does not match with the entrance condition in step S57, the CPU 9 controls the convey unit 7 to discharge the card C from the outdoor-side card input/output port 5A located on the card insertion side (S59), and the control routine advances to step S72. When the door 23 is not opened in step S61 and the discharge button 4A3 or 4B3 has been depressed (S63), the control routine goes to step S71 and the card C is discharged to the side where the discharge button 4A3 or 4B3 has been opened. If the discharge button 4A3 is not depressed in step S63, the CPU 9 monitors count information supplied from the timer 11 which has been set on the basis of the detection of the lock deactivation state by the electric lock state detecting unit 14. If a predetermined time period has passed (S64), the electric lock driving unit 13 is controlled once again to activate the electric lock 12 (S73), and the card C is held in the convey path 6. Then, the control routine goes to step S72. If the door 23 is opened in step S65 but not closed within a predetermined time period, the CPU 9 monitors count information from the timer 11 which has been set on the basis of the detection of the open state by the door state detecting unit 15. If it is determined that the opened door remains open for a predetermined time period or more, the buzzer is turned on to request the worker to close the door 23 /S66). If the door 2B is closed (S67), the control routine advances to step S68. If the discharge button 4BB is not depressed for a predetermined time period or more in step S69, the CPU 9 monitors count information supplied from the timer 11 which has been set on the basis of the detection of the closing of the door by the door state detecting unit 15. If it is determined that the discharge button 4B3 is not depressed for a predetermined time period or more, the control routine advances to step S74.

In the first embodiment, when the card C has been inserted on the outdoor side 20, the door 23 has been opened and closed and the card C has been discharged to the indoor side 21, it can be guessed that the worker entered. It is possible, however, that the worker did not enter. In this case, according to the third embodiment, the entering of the worker can exactly be confirmed on the basis of the depression of the discharge button 4B3. By providing the discharge button 4B3, more information than in the first embodiment, i.e. card insertion side information, door opening/closing information and discharge button depression information (card discharge direction information), can be obtained. Thus, the incoming/outgoing of a person can be exactly monitored in various cases. For example, if the obtained information indicates that the card has been inserted from the outdoor side 20, the door 23 has been opened and closed and thee card is discharged to the outdoor side 20, it is found that the worker has not entered since the card has been discharged to the card insertion side after the door 23 was opened and closed. If the obtained information indicates that the card has been inserted from the outdoor side 20, the door 23 has been opened and closed and the card has been discharged to the indoor side 21, it is found that the worker has entered since the card C has been discharged to the indoor side 21 after the card C was inserted and the door 23 was opened and closed. If the obtained information indicates that the card has been inserted from the outdoor side 20, the door 23 has been closed and the card has been discharged to the outdoor side 20, it is found that the worker has not entered since the card C has been discharged to the card insertion side after the card C was inserted and the door 23 was opened and closed. In addition, if the obtained information indicates that the card has been inserted from the outdoor side 20, the door 23 has been closed and the card has been discharged to the indoor side 21, it is found that an unlawful operation has been done, and therefore the operation of the discharge button 4B3 of the indoor side 21 is invalidated and the card is prevented from being discharged to the indoor side 21.

The present invention is not limited to the above embodiments and various modifications can be made without departing from the spirit of the present invention.

As has been described above in detail, according to the present invention, the direction of discharge of the storage medium is determined on the basis of the detection results of the insertion side detecting means and door state detecting means. Thus, the information relating to the entrance/exiting can exactly be obtained, and the storage medium can be inserted/discharged in/from either the front or rear side of the apparatus. Accordingly, the entering and exiting can be monitored and managed by a single apparatus.

In addition, the direction of discharge of the storage medium is determined on the basis of the detection result of the insertion side detecting means, the detection result of the door state detecting means, and the operation of the discharge button. Thus, the information relating to the entrance/exiting can exactly be obtained, and the storage medium can be inserted/discharged in/from either the front or rear side of the apparatus. Accordingly, the entering and exiting can be monitored and managed by a single apparatus.

Besides, information is read/written from/on the card by means of the read/write means, and the card is discharged on the basis of the instruction by the indication means. Thus, the information relating to the entrance/exiting can exactly be obtained, and the storage medium can be inserted/discharged in/from either the front or rear side of the apparatus. Therefore, the entering and exiting can be monitored and managed by a single apparatus.

Furthermore, the card is discharged on the basis of the instruction by the indication means, and it is determined whether the user has entered, exited, or suspended pended the action of entering/exiting, on the basis of the direction of discharge by the discharge means. Thus, the information relating to the entrance/exiting can exactly be obtained, and the storage medium can be inserted/discharged in/from either the front or rear side of the apparatus. Therefore, the entering and exiting can be monitored and managed by a single apparatus.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A gate apparatus for restricting passages of a parson by locking or unlocking a lock provided on a door, on a basis of a read result obtained by reading an inserted ID information storage medium, comprising:

means for conveying the inserted ID information storage medium between front and rear ends of the gate apparatus;

insertion-side detecting means for detecting whether the storage medium is inserted from the front or rear side;

control means for controlling said conveying means on the basis of detection results obtained by said insertion-side detection means to discharge the inserted storage medium from either the front end or the rear end of said gate apparatus;

means for reading the ID information from the inserted storage medium; and means for unlocking the lock when the ID information read by said reading means includes predetermined information.

2. A gate apparatus according to claim 1, further comprising:

door state detection means for detecting the open/-closed state of the door; and means for detecting whether a user has passed within a predetermined period of time.

3. A gate apparatus according to claim 2, wherein said control means includes means, when the user has not passed within the predetermined period of time, for discharging the storage medium from a side where the storage medium is inserted, and when the user has passed within the predetermined period of time, for discharging the storage medium from another side from which the storage medium is not inserted.

4. A gate apparatus according to claim 1, further comprising:

first display means provided on said front end of said gate apparatus;

second display means provided on said rear end of said gate apparatus; and means for displaying a disable state of the gate apparatus on one of said first and second display means opposite the side to which the storage medium is inserted.

5. A gate apparatus comprising:

convey means for conveying an ID information storage card formed to penetrate from an input side to an output side of a specified area where entering-/exiting of a person is to be monitored;

stopping means, provided midway along a convey path of said convey means, for stopping the card which has been inserted;

instruction means, provided at the input side and the output side, for instructing the direction of discharge of the card stopped by the stopping means; and discharge means for discharging the card in the direction indicated by said instruction means.

6. A gate apparatus according to claim 5, wherein said instruction means includes first and second indicating means provided at the inlet and outlet sides of the gate apparatus, respectively, for indicating discharge of the inserted card.

7. A gate apparatus according to claim 5, further comprising determining means for determining whether a user has entered, has exited, or has suspended the action of entering or exiting, on the basis of the direction of discharge by the discharge means.

8. A gate apparatus according to claim 5, wherein said instruction means for instructing the card discharge direction includes:

means for inputting the ID information of the user, the inputting means being provided at the inlet and outlet sides of the gate apparatus, respectively; and means for confirming the ID information of the user to set the side on which the ID information has been input, as the card discharge direction.

9. A card processing apparatus comprising:

first and second insertion ports provided for receiving a card at front and rear sides of the apparatus, respectively;

insertion-side detecting means for detecting an insertion side from which the card is inserted;

conveying means provided between the front and rear sides of the apparatus for conveying the card inserted from one of the front and rear sides to the other side;

first and second reading means so provided as to oppose one and the other side of the card conveyed by said conveying means, respectively;

means for stopping the card conveyed by said conveying means at first or second stopping position in accordance with a detection result of said insertion-side detecting means; and means for selecting one of said first and second reading means in such a manner that when the card is stopped at the first position the first reading means is selected and when the card is stopped at the second position the second reading means is selected.

10. A card processing apparatus according to claim 9, further comprising:

first and second card-discharge instructing means provided at the front and rear sides of the apparatus, respectively;

control means for controlling the card to be discharged at an instructed side of the front and rear sides by said first and second card-discharge instructing means.

11. A card processing apparatus according to claim 9, further comprising;

shutter means for closing one of the first and second insertion ports opposite to a port which is detected by a detection result of said insertion-side detecting means as a card inserted port.

12. A card processing apparatus according to claim 11, wherein said shutter means has a structure capable of being open at a discharging direction of the card which has been inserted to the apparatus.

13. A card processing apparatus according to claim 9, further comprising:

first and second display means provided respectively at the front and rear sides of the apparatus; and means for controlling said first and second display means to display a disable state on one of the first and second display means provided opposite to the insertion port to which the card has been inserted on the basis of a detection result of said insertion-side detecting means.

* * * * *